US007128644B2

(12) United States Patent
Linzey

(10) Patent No.: US 7,128,644 B2
(45) Date of Patent: Oct. 31, 2006

(54) COIN ROLL TYPE COIN OPERATED REDEMPTION GAME WHERE ROLLING COIN TURNS INTO IMAGE ON VIDEO SCREEN

(76) Inventor: Stephen Linzey, 174 Continental Ave., River Edge, NJ (US) 07661

( * ) Notice: Subject to any disclaimer, the term of this patent is extended or adjusted under 35 U.S.C. 154(b) by 600 days.

(21) Appl. No.: 10/274,466

(22) Filed: Oct. 18, 2002

(65) Prior Publication Data

US 2004/0077392 A1 Apr. 22, 2004

(51) Int. Cl.
*A63F 9/24* (2006.01)

(52) U.S. Cl. ..... 463/1; 273/460

(58) Field of Classification Search ..... 463/1, 463/49–57, 7; 273/340, 118 A, 108, 281, 273/138.3, 460

See application file for complete search history.

(56) References Cited

U.S. PATENT DOCUMENTS

| | | | | |
|---|---|---|---|---|
| 3,269,731 | A * | 8/1966 | Koci et al. | 463/52 |
| 4,008,893 | A * | 2/1977 | Yoseloff | 463/2 |
| 5,445,376 | A * | 8/1995 | Bromley | 273/109 |
| 6,036,188 | A * | 3/2000 | Gomez et al. | 273/118 R |
| 6,129,353 | A * | 10/2000 | DeMar et al. | 273/119 R |
| 6,155,565 | A * | 12/2000 | Gomez et al. | 273/118 R |
| 6,520,500 | B1 * | 2/2003 | Pierce et al. | 273/108 |

OTHER PUBLICATIONS

"Chicken Dash," Konami (America) Inc. Registered Trademark of Konami, © 1995, 900 Deerfield Road, Buffalo Grove, IL 60089-4510.

"Coin Circus," American Sammy Corporation, © 1994, Coin Circus™ is a Trademark of American Sammy Corporation., 901 Cambridge Drive, Elk Grove, IL 6007.

"Home Run Hitter," Distributed by Coin Concept Inc., 16 Edgeboro Road, Unit 5, East Brunswick, N.J. 08816. (Patent Pending).

"Loose Change," Coastal Amusement, Inc., 601 Prospect Street, Lakewood, N.J. 08701, Http://www.costalamusements.com.

"Rock-n-Bowl Earnings?," U.S. Patent # 5,071,127, © 1992 Bromley Incorporated.

"Sonic the Hedgehog,"™ SEGA Enterprises (USA) by Sting International 275 Shoreline Drive, Suite 201, Redwood City, CA 94065.

"Turbo Ticket,"© 1996 Exidy, All rights reserved. 60/108,695 Patent Pending., 2688 C Middlefield Road, Redwood City, CA 94063.

"Volcanic Airruption," Distributed by: Coin Concepts, Inc., 19 Lexington Avenue, East Brunswick, N.J. 08816.

* cited by examiner

*Primary Examiner*—Robert Olszewski
*Assistant Examiner*—Kesha Y. Frisby
(74) *Attorney, Agent, or Firm*—Walter J. Tencza, Jr.

(57) ABSTRACT

A coin rolled from a first end of a surface to a second end of a surface is detected by a sensing device. The sensing device causes a video screen to display a coin generated video object in response to the detection of the coin near the second end of the surface. The video screen may also display at least one target video object. The coin generated object may be displayed by the video screen in a manner so that it appears that the coin generated object moves on the video screen in a direction related to the direction of the physically rolling coin. The target video object may change from a first state to a second state on the video screen when the coin generated object is within a specified range of the target video object.

13 Claims, 10 Drawing Sheets

COIN ROLL TYPE COIN OPERATED REDEMPTION GAME WHERE ROLLING COIN TURNS INTO IMAGE ON VIDEO SCREEN

FIELD OF THE INVENTION

This invention relates to improved methods and apparatus concerning coin rolling, coin operated redemption games.

BACKGROUND OF THE INVENTION

Various coin rolling games are provided in the prior art in which a coin is rolled and physically comes into contact with a physical object. For example, a coin rolling bowling game is known in which a coin is rolled and the coin hits one or more physical bowling pins.

SUMMARY OF THE INVENTION

The present invention in one or more embodiments provides an apparatus comprising a surface or playfield having a first end and a second end, a video screen located near the second end of the surface, and a sensing device located near the second end of the surface. A coin can be rolled from the first end of the surface to the second end of the surface. The sensing device detects the coin near the second end of the surface, and the sensing device causes the video screen to display a coin generated video object in response to the detection of the coin near the second end of the surface.

The video screen may also display at least one target video object. The coin generated object may be displayed by the video screen in a manner so that it appears that the coin generated object moves, typically from the bottom of the video screen to the top of the video screen. The coin generated object may appear to move on the video screen in a direction, which is related to the direction in which the coin was rolling. The coin generated object may appear to move from the bottom the video screen to the top of the video screen, and in a direction with respect to a plane of the video screen which is substantially the same as the direction in which the coin was rolling with respect to a plane of the surface.

The target video object may change from a first state to a second state on the video screen when the coin generated object is near the target video object, wherein the first state and the second state differ. The change of the target video object from the first state to the second state may be comprised of a change in appearance or characteristic of the target video object such as a change in color, shape, size, location, or expression (for example if the target video object is a human cartoon character, the facial expression may change from a smile to a frown) or any other change in appearance. The change in state for the target video may be a change from a stationary state to a state of activity or movement. A plurality of other video objects may also change from a first state to a second state when the coin generated object is within a certain distance of a target video object on the video screen.

A method is also provided comprising the steps of detecting a coin after the coin has rolled over a surface; and displaying on a video screen a coin generated video object upon detecting the coin.

The present invention in one or more embodiments combines rolling a coin with a response on a video screen such as the video screen of a computer monitor. The rolling coin may effectively turn into a coin generated video object, such as a moving animal, to be displayed on the video screen. The coin generated video object brought about by the rolling coin, may encounter, overlap, or come in contact with other video objects on the video screen, which may be called target video objects. The target video objects may be, for example, video images or cartoon images of people, animals, buildings, inanimate objects, animated objects, or any other kind of video images.

When the coin generated video object comes in contact with, overlaps, or hits a target video object, the target video object may change state or have a reaction to the encounter with the coin generated object. For example, if the coin generated object is a rat, and the rat comes in contact with a mom pushing a baby carriage, the mom may faint. The video object of the mom may change gradually or immediately change from a state of standing still to a state of lying down on the ground from having fainted. In addition to a hit "reaction" or change of state, each target video object may have a near miss reaction when the coin generated object comes close to contacting or overlapping the respective target object.

In addition, the present invention in one or more embodiments provides that the coin generated object can "enter" the door of a business and thereby change the image on the entire screen from a scene outside the business to a scene inside the business.

DETAILED DESCRIPTION OF THE DRAWINGS

Figure 1A:
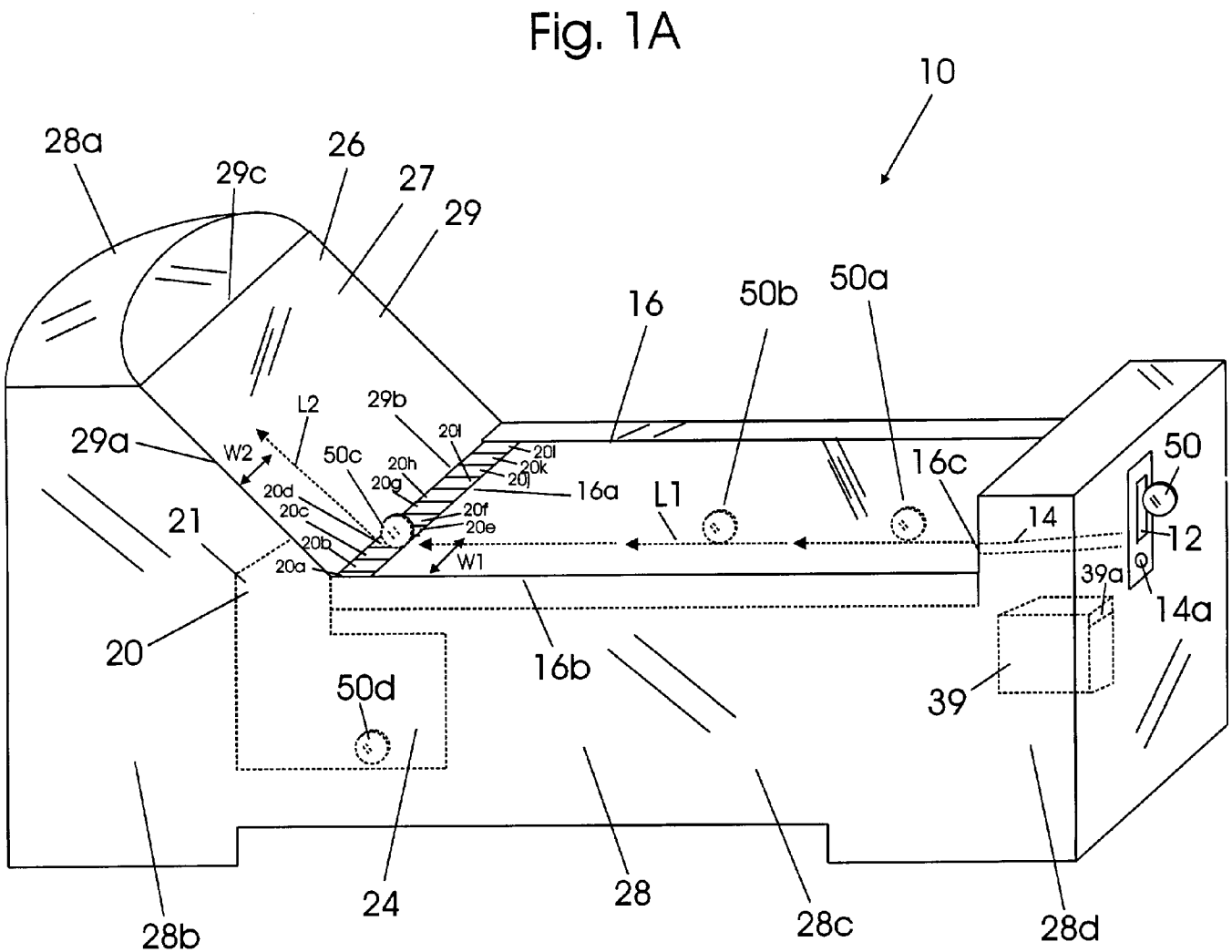
FIG. 1A shows a perspective view of an apparatus in accordance with a first embodiment of the present invention where a coin is rolled in a first direction.

FIG. 1A shows a perspective view of an apparatus 10 in accordance with a first embodiment of the present invention where a coin 50 is rolled in a first direction. The apparatus 10 includes a slot 12, an inclined chute 14, a surface or playfield 16, a plurality of sensing devices, such as sensing devices 20*a*, 20*b*, 20*c*, 20*d*, 20*e*, 20*f*, 20*g*, 20*h*, 20*i*, 20*j*, 20*k*, and 20*l*, a coin repository 24, a screen device 26, and a housing or cabinet 28. The screen device 26 is typically comprised of a screen 29 and a computer processor 27 which runs a computer program for displaying video objects or visual images on the screen 29. The sensing devices 20*a*–20*l* are electronically connected to the computer processor 27 of the screen device 26. Electronic connection may be wireless, hardwired, optical, electromagnetic or any other type of communication connection. The housing or cabinet 28 is comprised of portions 28*a*, 28*b*, 28*c*, and 28*d*. The sensing devices 20*a*–*l* may be comprised of slot in which, or near which is located any type of mechanism for sensing the presence of a coin such as a mechanical switch, a light emitting diode and light detector, an electromagnetic switch, an optical switch, or any other type of sensing device. There may be as many sensing devices (like sensing device 20*a*) as desired, however, the number of sensing devices would probably not be less than three or greater than twenty depending on the computer software requirements of computer software running on the computer processor 27 of the screen device 26.

Figure 1B:
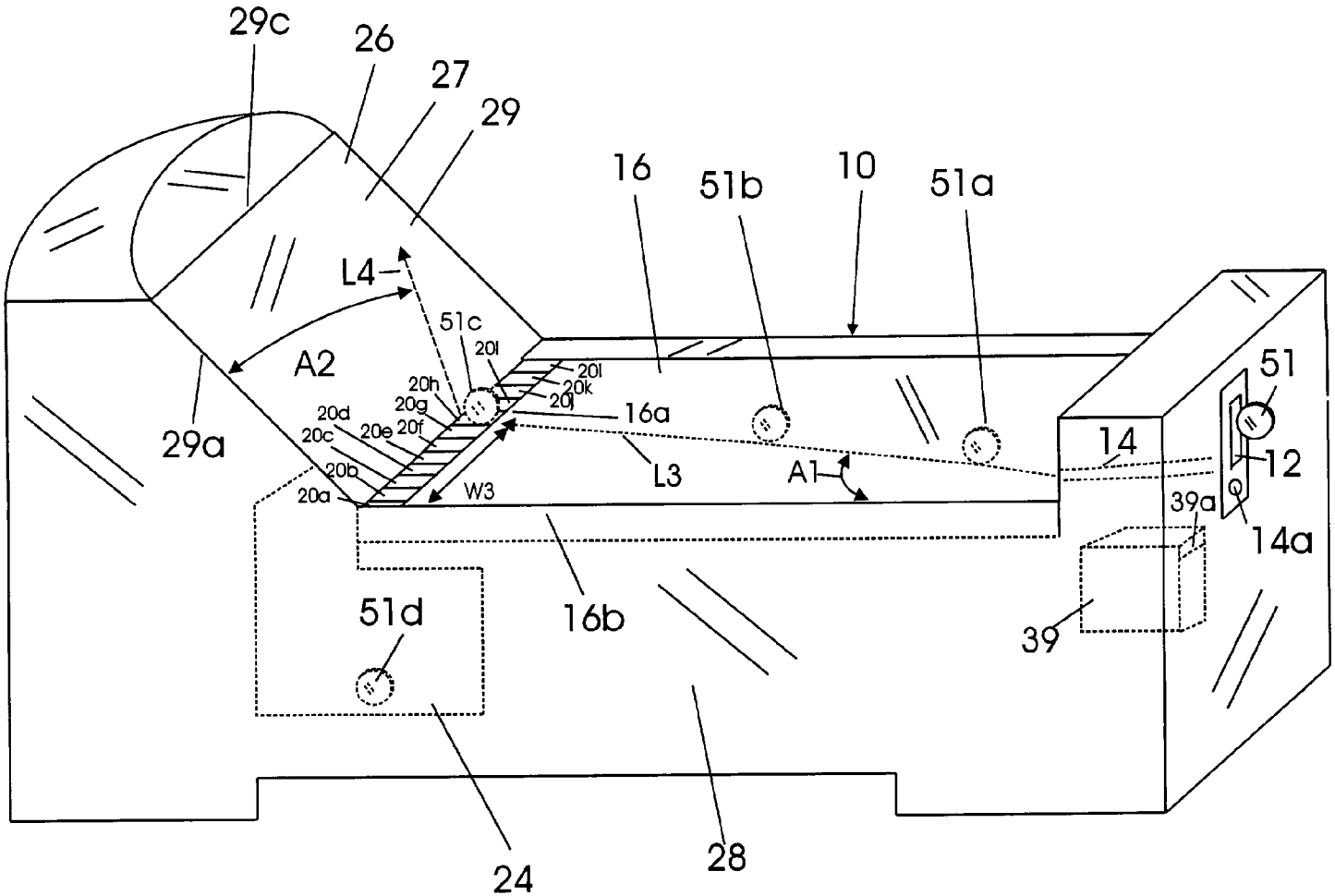
FIG. 1B shows a perspective view of the apparatus of FIG. 1 where a coin is rolled in a second direction.

A ticket dispensing device 39, whose location is shown by dashed lines in FIGS. 1A and 1B, may be located within the housing or cabinet 28. The ticket dispensing device 39 may have a slot 39*a* for dispensing tickets. The ticket dispensing device 39 communicates with the computer processor 27 of the screen device 26 and may dispense a given number of tickets under for example, certain circumstances, as will be explained herein.

The surface or playfield 16 should be set into the housing or cabinet 28 under glass not shown, so that the coin 50 after insertion into the slot 12, cannot be accessed by a player (without a device such as a key to the apparatus 10 or a device similar to a key).

The devices 20*a*–*l* may be considered to be a single integrated sensing device. The plurality of devices 20*a*–*l* may be provided along the width of an end 16a of the surface 16. The coin repository 24 is shown in dashed lines and is typically hidden inside the housing 28 so that coins, such as coin 50, falling into the coin repository 24 cannot be taken out unless one has a key, for example, to a locked door not shown. The inclined chute 14 may be steered by a button 14*a* located on the portion 28*d* of the housing or cabinet 28. The button 14*a* can steer the chute 14 so that the coin 50 can be made to roll in different directions, such as in the direction shown, i.e. east to west, along the line L1 in FIG. 1A or in the direction shown along the line L3 in FIG. 1B. The inclined chute 14 may give the coin direction and speed. The inclined chute 14 or an attached or included coin mechanism and guide may swivel and thus may be steered by the button 14*a* to steer the coin 50 or 51. Mechanisms for steering the coin 50 or 51 and for such inclined chutes 14 are known in the art.

In operation, an individual first adjusts the button 14*a* so that the inclined chute 14 is pointed in the desired direction. The individual then drops a coin 50 into the slot 12. The coin 50 drops through the slot 12 and lands on the inclined chute 14. The coin 50 would typically travel through a coin validation mechanism, not shown, to ensure that the coin is a true quarter or a true token, for example. Coin validation mechanisms are known in the art. The coin validation mechanism can be electrically connected to the computer processor 27 of the screen device 26 so that if there is a valid coin, a timing mechanism can be started to allow a certain amount of time for the coin to reach the end 16*a* of the surface 16 before the apparatus 10 would assume that there has been an error.

The coin 50 rolls along the inclined chute 14 and then onto the playing surface 16 until the coin is at a position 50*a*, shown in dashed lines in FIG. 1A. The surface 16 may be a flat and smooth surface, which allows the coin 50 to roll freely. The coin 50 continues to roll, eventually reaching position 50*b* and then position 50*c* at the end 16*a* of the surface 16. The coin 50 then falls off of the surface 16 and through the sensing device 20*d*, which is the fourth sensing device from the end 16*b* of the playing surface 16.

Each sensing device 20*a*–*l* may have a chamber or slot through which the coin 50 would fall. In FIG. 1A, the coin falls through sensing device 20*d*. The sensing device 20*d* In FIG. 1A senses the coin 50 as the coin falls, due to gravity, from the position 50*c*. The sensing device 20*d* may provide a coin signal to the computer monitor 27 of the screen device 26. The coin signal may indicate both the coin's presence and the location along the end 16*a* of the surface 16 where the coin 50 fell off of the surface 16. For example, the coin signal may indicate that the coin 50 fell off of the surface 16*a* into sensing device 20*d* at a distance of W1 from the left edge 16*b* of the surface 16.

The screen device 26 and/or the computer processor 27 of the screen device 26, responds to the coin signal by displaying a coin generated video object on the screen 29 of the screen device 26. The coin generated video object may be displayed so that it appears to slowly come onto the screen 29 at a location, which is near, within a certain range, where the coin 50 fell off of the surface 16. For example, if the coin 50 fell off of the end 16*a* of the surface 16 at a distance of W1 from the edge 16*b* of the surface 16, then the coin generated video object may appear at a distance W2 from the edge 29*a* of the screen 29, where W1 and W2 are the same, near the bottom 29*b* of the screen 29. The end 16*a* of the surface 16 and the end 29*a* of the screen 29 may lie in substantially the same plane. Basically, the coin generated video object appears to be a continuation of the rolling of the coin 50. The computer processor 27 of the screen device 26, is programmed to make the coin generated video object move up, or appear to move up the screen 29 of the screen device, from the bottom 29*b* towards the top 29*c* in a direction L2. (This can be done by displaying a succession of video images which are slightly different from one another or in slightly different states).

The screen 29 is located in a plane. The direction L2 of the movement of the coin generated video object in the plane of the screen 29 is related to the direction L1 of the movement of the coin 50 in the plane of the surface 16. If the coin 50 moves in the direction of line L1, perpendicularly to the ends 16*a* and 16*c*, of the surface 16, then the computer processor 27 of the screen device 26 can be programmed to cause the coin generated video object to move in the direction of line L2, perpendicularly to the bottom 29*b* and the top 29*c* of the screen 29. The start of line L2 at the bottom 29*b* would be near to the end of the line L1 at the end 16*a*. This makes it appear as though the coin generated video object is merely continuing the movement of the rolling coin 50.

FIG. 1B shows the perspective view of the apparatus 10 of FIG. 1 where a coin 51 is rolled in a second direction shown by the line L3. The coin 51 may be identical to the coin 50. The button 14*a* may be pressed to move the inclined chute 14 to a position different from that shown in FIG. 1A, causing the different direction of movement shown by line L3. The coin 51, after being dropped through the slot 12, falls onto the inclined chute 14 and then rolls onto the surface to position 51*a*. The coin 51 rolls through positions 51*a* and 51*b*. When the coin 51 falls off of the surface 16, at or near position 51*c*, it enters a slot for sensing device 20*h*.

The sensing device 20*h* indicates the lateral position along the width of the surface 16 wherein the coin 51 falls off the end 16*a*. The lateral position in FIG. 1B is about a distance W3 from the edge 16*b* of the surface 16. The coin falls through the sensing device 20*h* and is detected by the sensing device 20*h*. The sensing device 20*h* sends a coin signal to the computer processor 27 of the screen device 26. The coin signal provides an indication of the location where the coin 51 fell of the surface 16 at end 16*a*. The coin is deposited in the coin repository at position 51*d*.

The angle A1 between the line L3 (the direction of rolling of the coin 51) and the edge 16*b* of the surface 16 is the same as the angle A2 between the line L4 (the direction of movement of a coin generated video object which is created in response to the coin 51) and the edge 29*a* of the screen 29. In this manner the coin 51 appears to change into the coin generated video object on the screen 29, and/or to continue to move in a related direction.

Figure 2A:
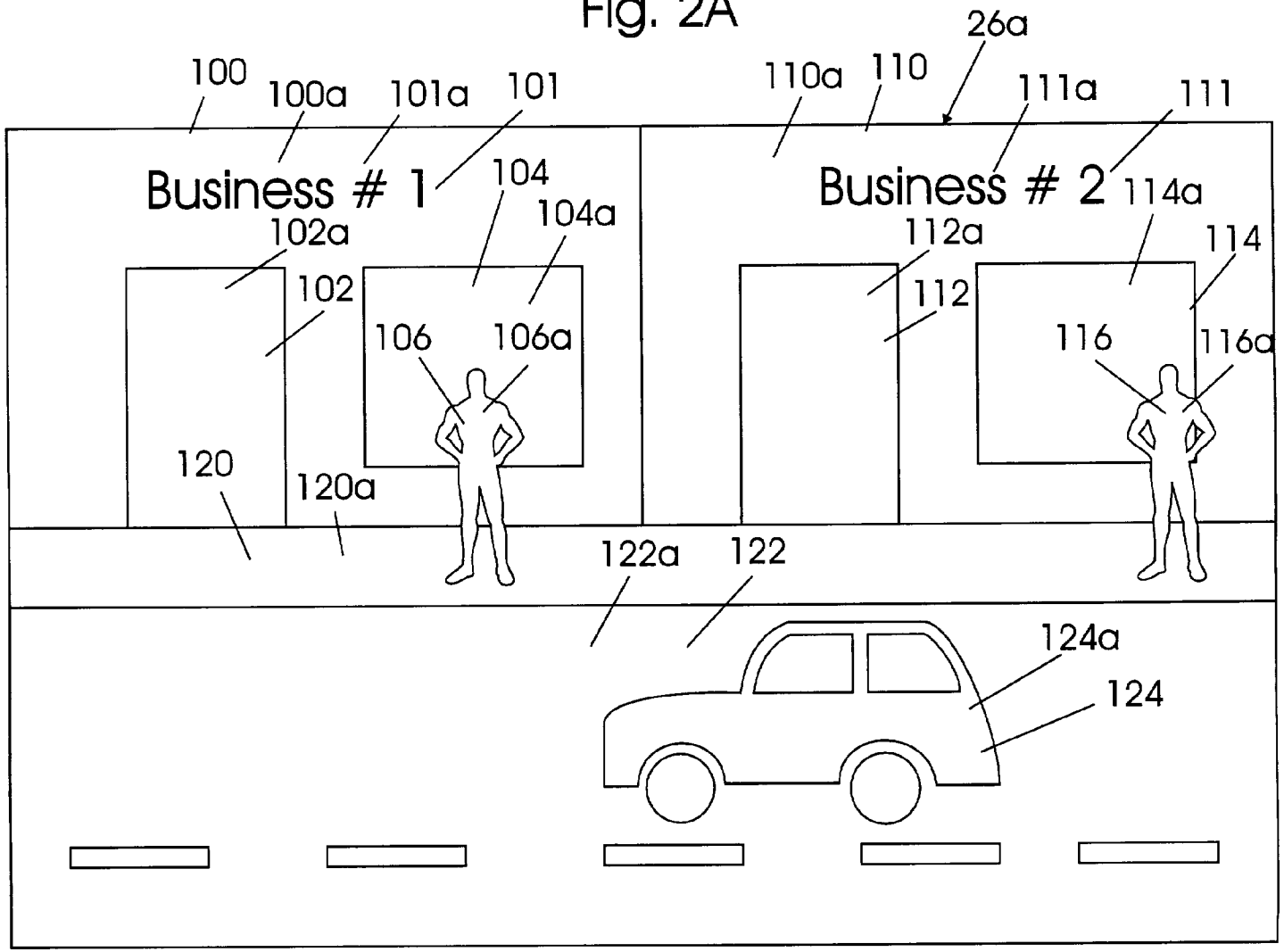
FIG. 2A shows a first video image comprised of a plurality of video objects in a first state to be displayed on a screen device for use with the apparatus of FIG. 1A.

FIG. 2A shows a first video image 26*a* comprised of a plurality of video objects in a first state to be displayed on the screen 29 for use with the apparatus 10 of FIG. 1A. The first video image 26*a* includes video objects 100 and 110 which may include images or representations of first and second businesses such as restaurants or stores. The video object 100 may be further comprised of further video objects such as a store name 101, a door 102, and a window 104. The video object 110 may be further comprised of further video objects such as a store name 111, a door 112, and a window 114. The first video image 26*a* may include further video objects such as persons 106 and 116, sidewalk 120, road 122, and car 124. Each video object is shown in a first state in FIG. 2A. Video objects 100, 101, 102, 104, 106, 110, 111, 112, 114, 116, 120, 122, and 124 are shown in states 100*a*, 101*a*, 102*a*, 104*a*, 106*a*, 110*a*, 111*a*, 112*a*, 114*a*, 116*a*, 120*a*, 122*a*, and 124*a*. Each of these video objects may change shape, size, color, or location on the screen 29 as time goes by and in response to the computer processor 27 of the screen device 26. Each of these video objects may be animated. Each of these video objects may be considered to be a target video object. The states 100*a*, 101*a*, 102*a*, 104*a*, 106*a*, 110*a*, 111*a*, 112*a*, 114*a*, 116*a*, 120*a*, 122*a*, and 124*a*, in this example, are the states of the appropriate video objects just prior to the screen device 26 modifying the screen 29 in response to a rolling coin, such as coin 50 or 51.

Figure 2B:
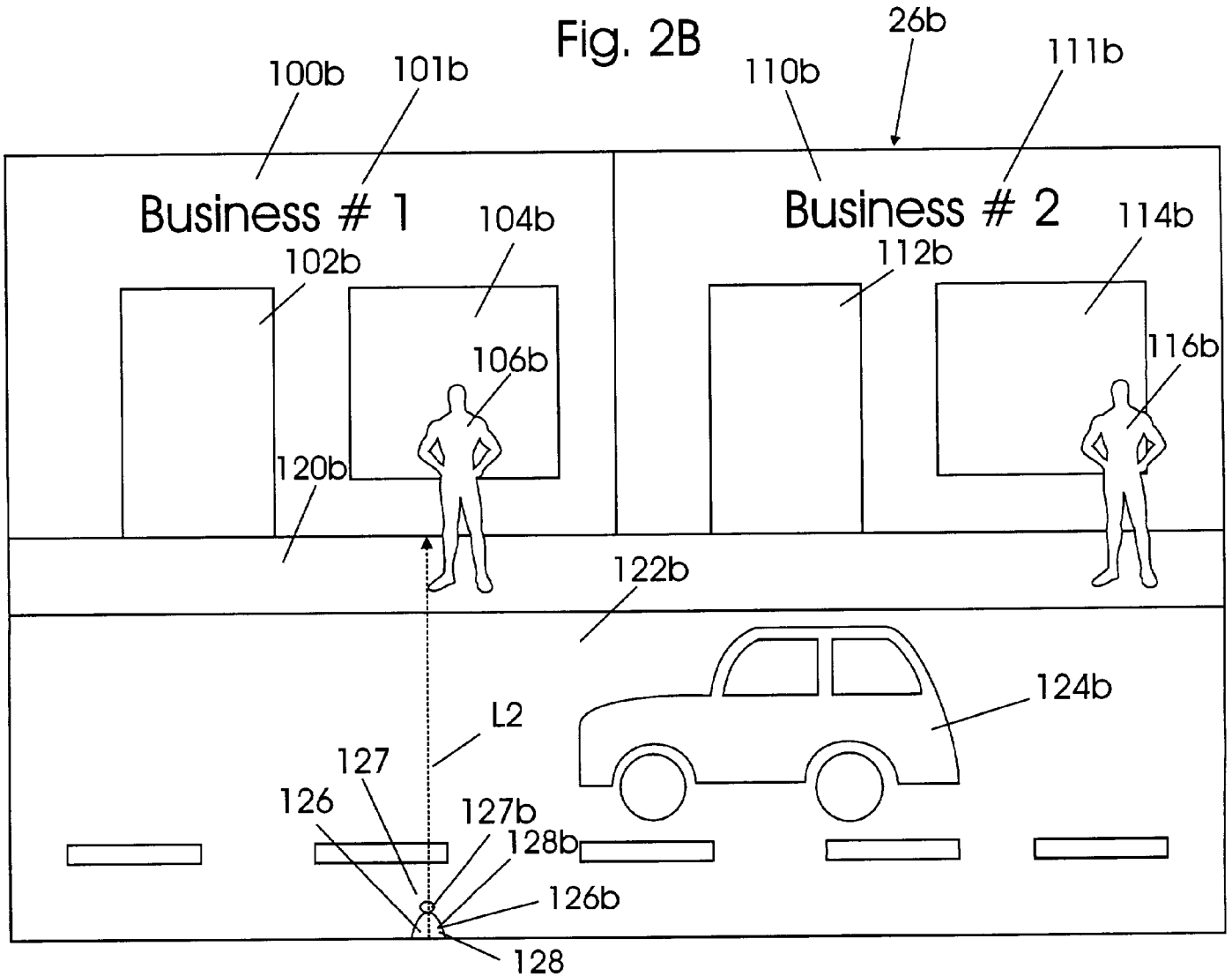
FIG. 2B shows a second video image of a plurality of video objects in a second state to be displayed on the screen device for use with the apparatus of FIG. 1A.

FIG. 2B shows a second video image 26*b* of a plurality of video objects in a second state to be displayed on the screen 29 of the screen device 26 for use with the apparatus 10 of FIG. 1A. In FIG. 2B a coin, such as a coin 50 has been detected and the screen device 26 has changed the image on the screen 29 from video image 26*a* to video image 26*b*. In video image 26*b*, the video objects 100, 101, 102, 104, 106, 110, 111, 112, 114, 116, 120, 122 are now in states 100*b*, 101*b*, 102*b*, 104*b*, 106*b*, 110*b*, 111*b*, 112*b*, 114*b*, 116*b*, 120*b*, 122*b*, and 124*b*, respectively, which for simplification are substantially the same as states 100*a*, 101*a*, 102*a*, 104*a*, 106*a*, 110*a*, 111*a*, 112*a*, 114*a*, 116*a*, 120*a*, 122*a*, and 124*a* of FIG. 2A. However, unlike video image 26*a*, video image 26*b* includes a portion of a coin generated video object, which in this example is a video rat 126 in a state 126*b*. The video rat 126 has a nose 127 displayed in a state 127*b* and a portion of its body 128 is displayed in a state 128*b*. The video rat 126 is placed on the screen 29 by the screen device 26 (which may include a computer processor 27) at a location corresponding closely to the location where a coin, such as coin 50, fell off of the surface 16 at the end 16*a*, as shown in FIG. 1A. The video rat 126 will move up the screen 29 in the direction and along line L2, also previously referred to in FIG. 1A which relates as previously specified to the direction of line L1 of movement of the actual rolling coin.

Figure 2C:
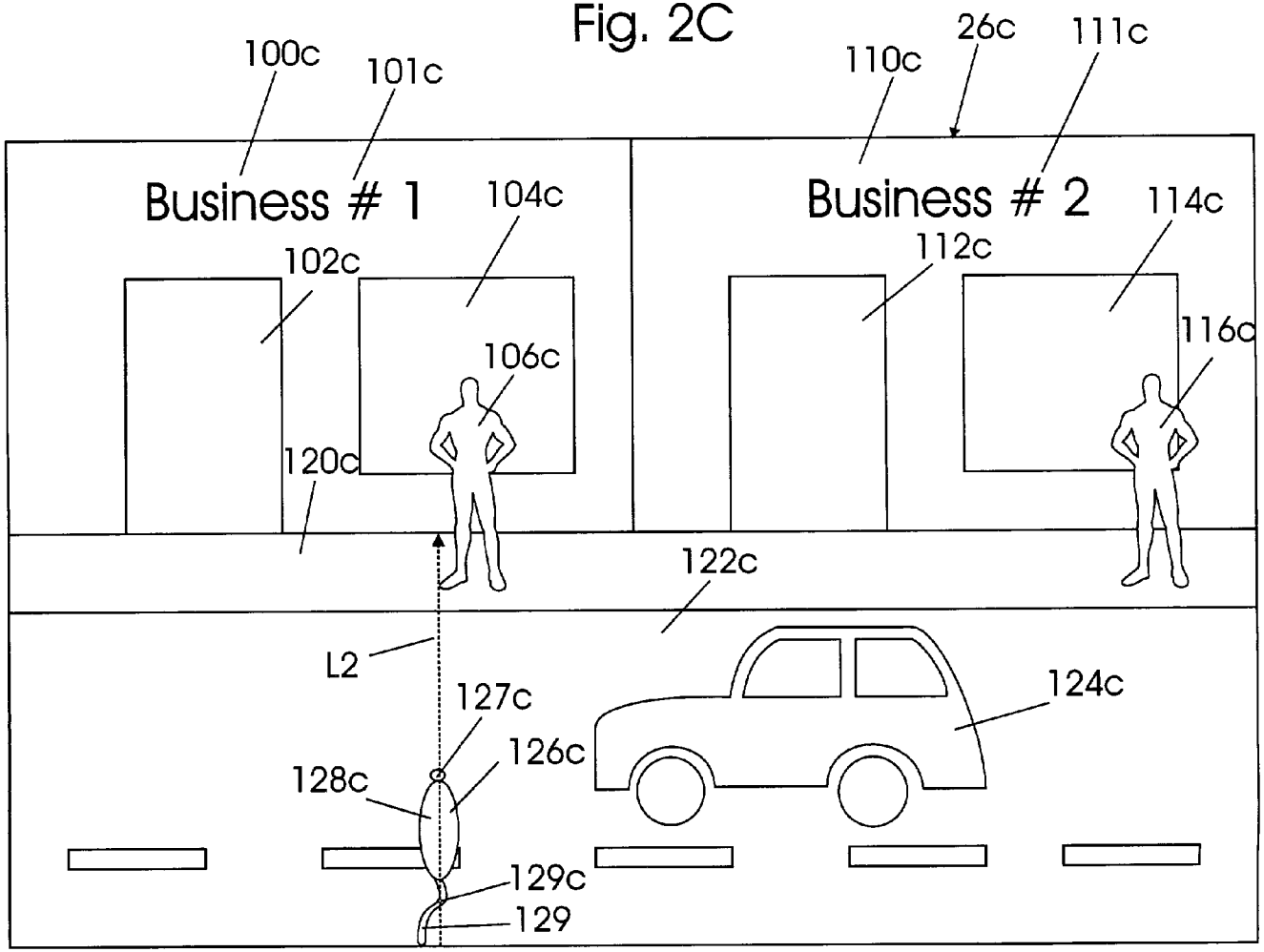
FIG. 2C shows a third video image comprised of a plurality of video objects in a third state to be displayed on the screen device for use with the apparatus of FIG. 1A.

FIG. 2C shows a third video image 26*c* comprised of a plurality of video objects in a third state to be displayed on the screen device 26 for use with the apparatus 10 of FIG. 1A. In the third video image 26*c* the rat 126 has moved further out onto the screen 29 in the direction of line L2. A tail 129 of the rat 126 can now be seen on the screen 29. The nose 127, the body 128, and the tail 129 are shown in states 127*c*, 128*c*, and 129*c* in the video image 26*c*. The other video objects, such as 100, 101, 102, 104, 106, 110, 111, 112, 114, 116, 120, 122 are now in states 100*c*, 101*c*, 102*c*, 104*c*, 106*c*, 110*c*, 111*c*, 112*c*, 114*c*, 116*c*, 120*c*, 122*c*, and 124*c*, respectively, which for simplification are substantially the same as states 100*a*, 101*a*, 102*a*, 104*a*, 106*a*, 110*a*, 111*a*, 112*a*, 114*a*, 116*a*, 120*a*, 122*a*, and 124*a* of FIG. 2A.

Figure 2D:
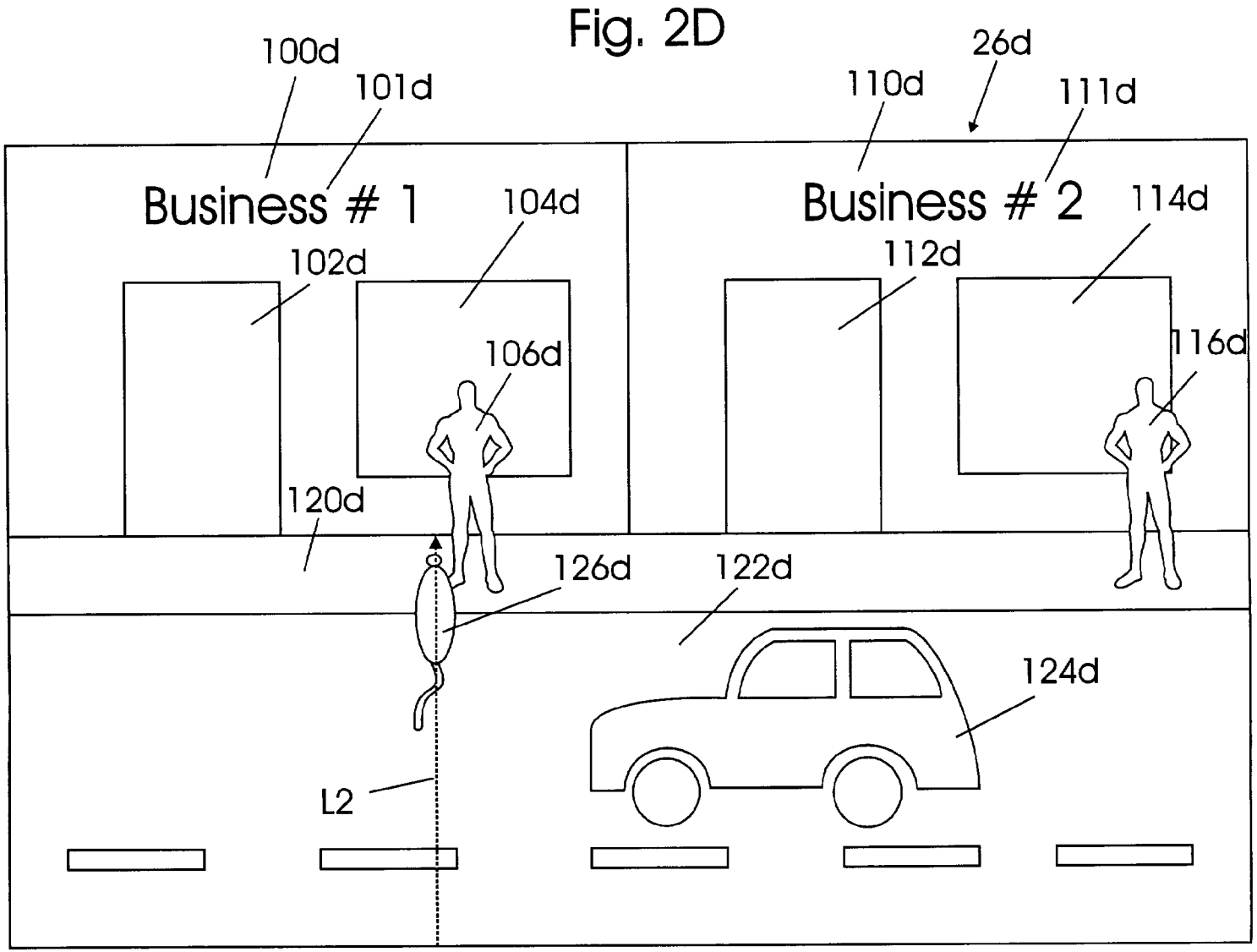
FIG. 2D shows a fourth video image of a plurality of video objects in a fourth state to be displayed on the screen device for use with the apparatus of FIG. 1A.

FIG. 2D shows a fourth video image 26*d* of a plurality of video objects in a fourth state to be displayed on the screen 29 of the screen device 26 for use with the apparatus 10 of FIG. 1A. In the fourth video image 26*d* the rat 126 has moved further up on the screen 29 in the direction of line L2. The video rat 126 in state 126*d* now overlaps a state 106*d* of the person video object 106. I.e. it appears that the video rat 126 is on the toe of the person 106. The other video objects, such as 100, 101, 102, 104, 110, 111, 112, 114, 116, 120, 122 are now in states 100*d*, 101*d*, 102*d*, 104*d*, 110*d*, 111*d*, 112*d*, 114*d*, 116*d*, 120*d*, 122*d*, and 124*d*, respectively, which for simplification are substantially the same as states 100*a*, 101*a*, 102*a*, 104*a*, 110*a*, 111*a*, 112*a*, 114*a*, 116*a*, 120*a*, 122*a*, and 124*a* of FIG. 2A.

Figure 2E:
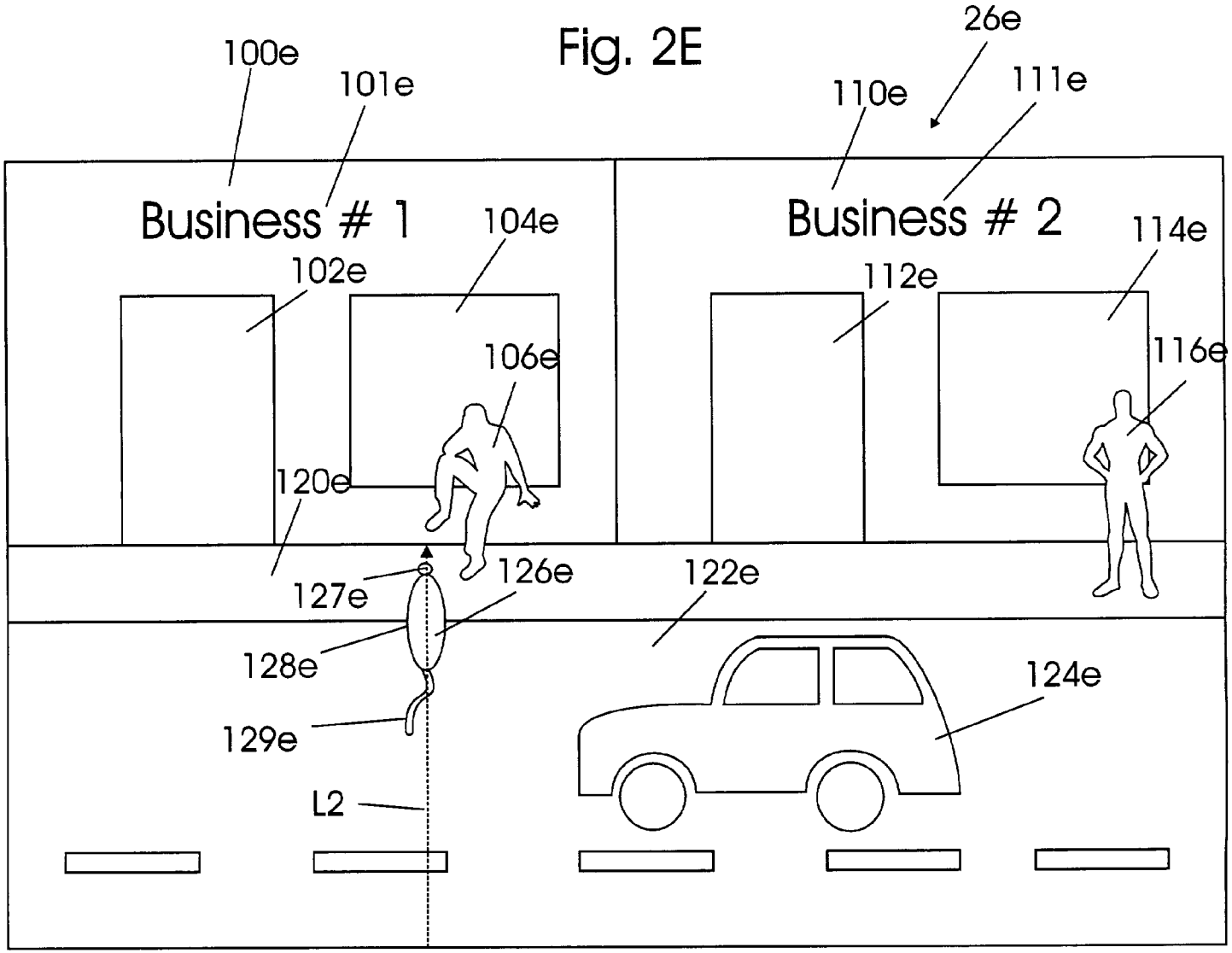
FIG. 2E shows a fifth video image of a plurality of video objects in a fifth state to be displayed on the screen device for use with the apparatus of FIG. 1A.

Just after the rat 126 begins to overlap the person 106, or when the rat 126 is within a certain distance of the person 106, the person video object 106 may show a "reaction" by changing to another state such as state 106*e* shown in FIG. 2E. FIG. 2E shows a fifth video image 26*e*. In FIG. 2E the person video object 106 has reacted to the rat 126 by lifting up his/her foot to put himself or herself in a state 106*e*. The other video objects, such as 100, 101, 102, 104, 110, 111, 112, 114, 116, 120, 122, and 126 are now in states 100*e*, 101*e*, 102*e*, 104*e*, 110*e*, 111*e*, 112*e*, 114*e*, 116*e*, 120*e*, 122*e*, 124*e*, and 126*e* respectively, which for simplification are substantially the same as states 100*a*, 101*a*, 102*a*, 104*a*, 110*a*, 111*a*, 112*a*, 114*a*, 116*a*, 120*a*, 122*a*, and 124*a* of FIG. 2A, and 126*d* of FIG. 2D.

Figure 3:
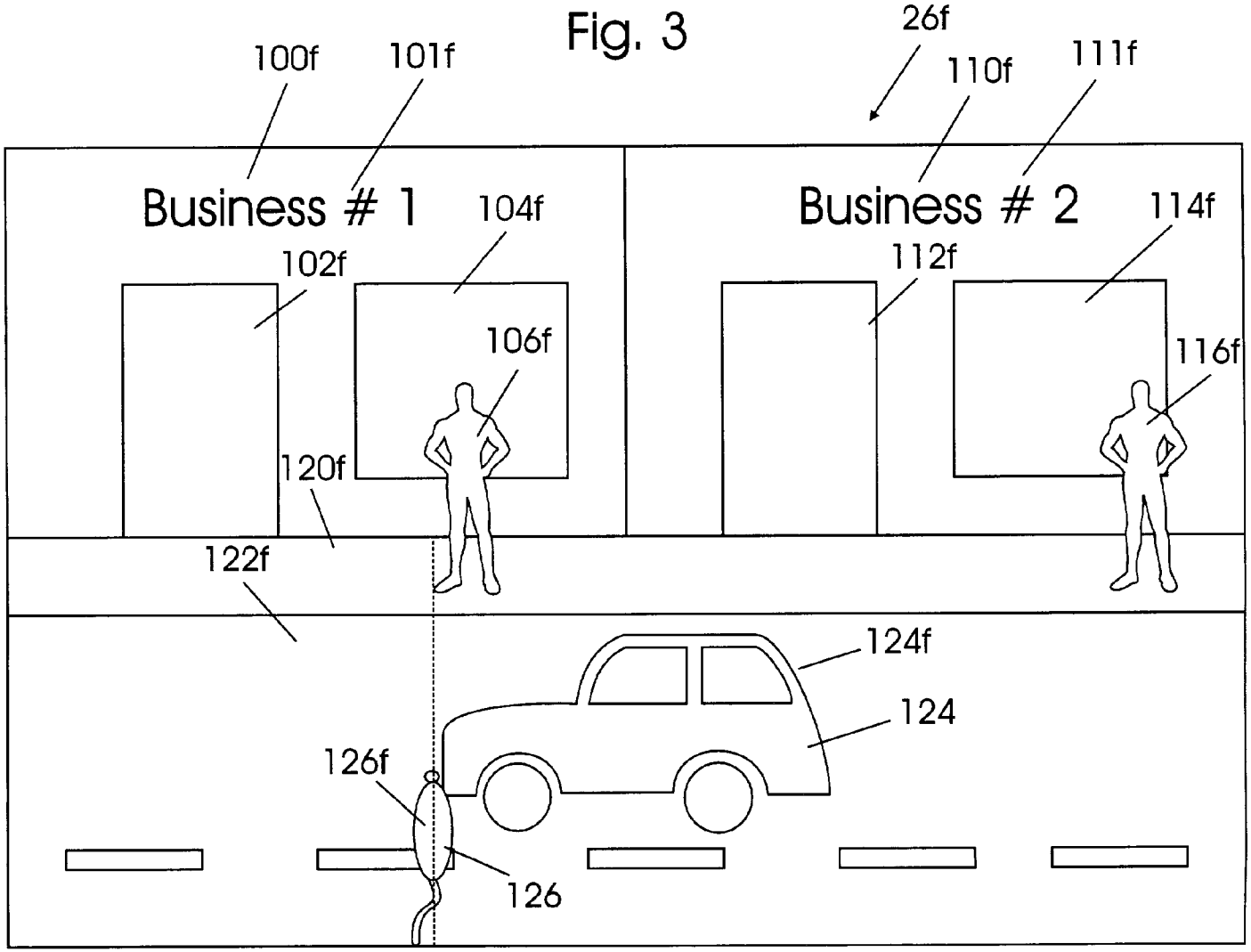
FIG. 3 shows a sixth video image of a plurality of video objects in a sixth state to be displayed on the screen device for use with the apparatus of FIG. 1A.

FIG. 3 shows a sixth video image 26*f* of a plurality of video objects in a sixth state to be displayed on the screen 29 of the screen device 26 for use with the apparatus 10 of FIG. 1A. In FIG. 3 the car video object 124 has moved to a state 124*f* where it contacts or overlaps the rat 126 in a state 126*f*. The car video object 124 may have moved gradually and seamlessly across the screen from state 124*a* in FIG. 2A to state 124*f* in FIG. 3. The other video objects, such as 100, 101, 102, 104, 110, 111, 112, 114, 116, 120, 122, and 126 are now in states 100*f*, 101*f*, 102*f*, 104*f*, 110*f*, 111*f*, 112*f*, 114*f*, 116*f*, 120*f*, 122*f*, and 124*f*, respectively, which for simplification are substantially the same as states 100*a*, 101*a*, 102*a*, 104*a*, 110*a*, 111*a*, 112*a*, 114*a*, 116*a*, 120*a*, 122*a*, and 124*a* of FIG. 2A.

Immediately after the rat 126 or rat state 126*f* has contacted the car 124 or car state 124*f*, the rat 126 may change shape or form into a squashed rat (to represent being run over by the car 124) or into some other form.

Figure 4A:
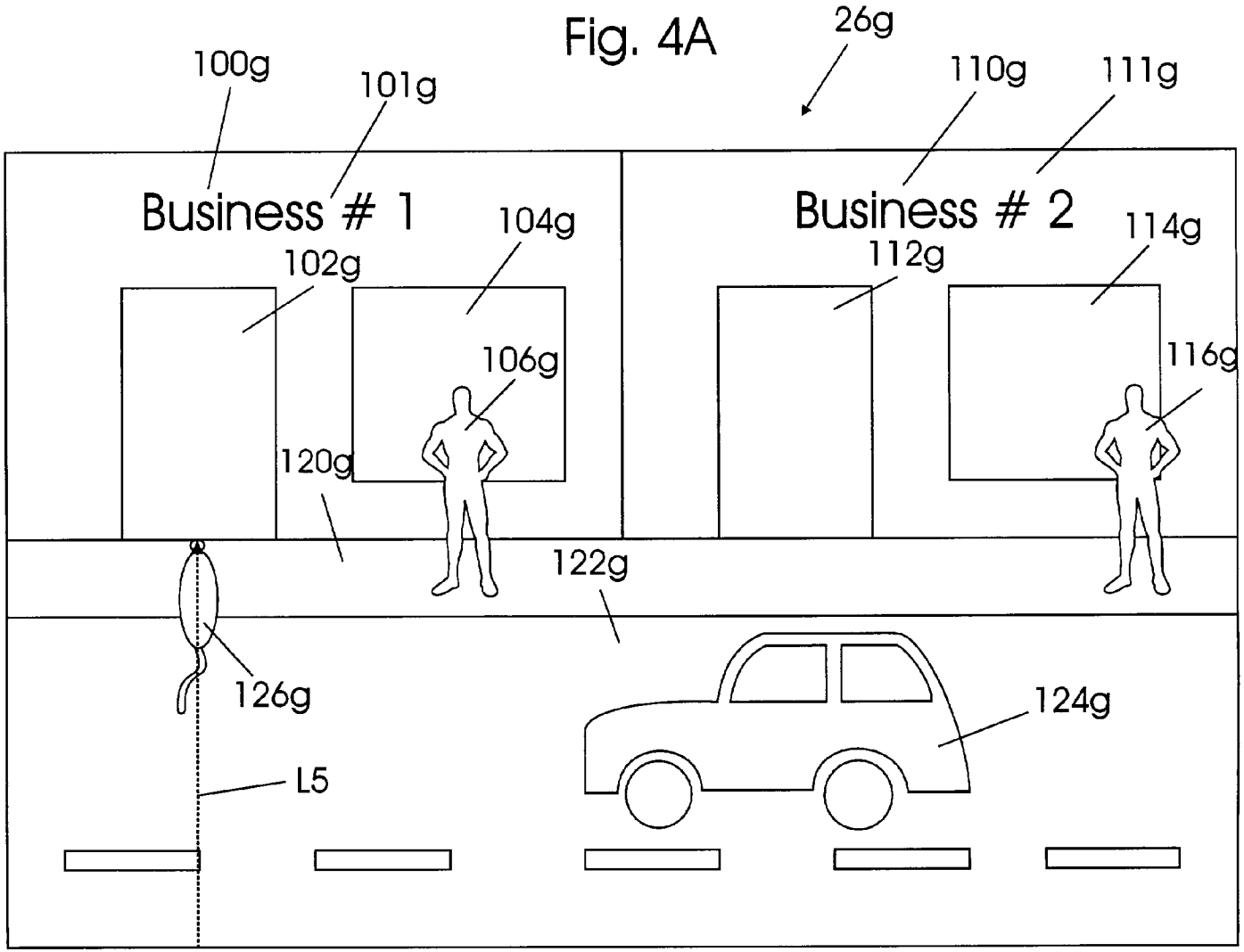
FIG. 4A shows a seventh video image of a plurality of video objects in a seventh state to be displayed on the screen device for use with the apparatus of FIG. 1A.

FIG. 4A shows a seventh video image 26*g* of a plurality of video objects in a seventh state to be displayed on the screen 29 of the screen device 26 for use with the apparatus 10 of FIG. 1A. In FIG. 4A the rat 126 has traveled along the line L5 up from the bottom 29*b* of the screen 29 to the middle of the screen 29. The line L5 may correspond to a different line of direction of a different rolling coin. The rat 126 is shown in FIG. 4A in a state 126*g* in which the rat 126 is just beginning to contact the door 102 in the state 102*g*.

Figure 4B:
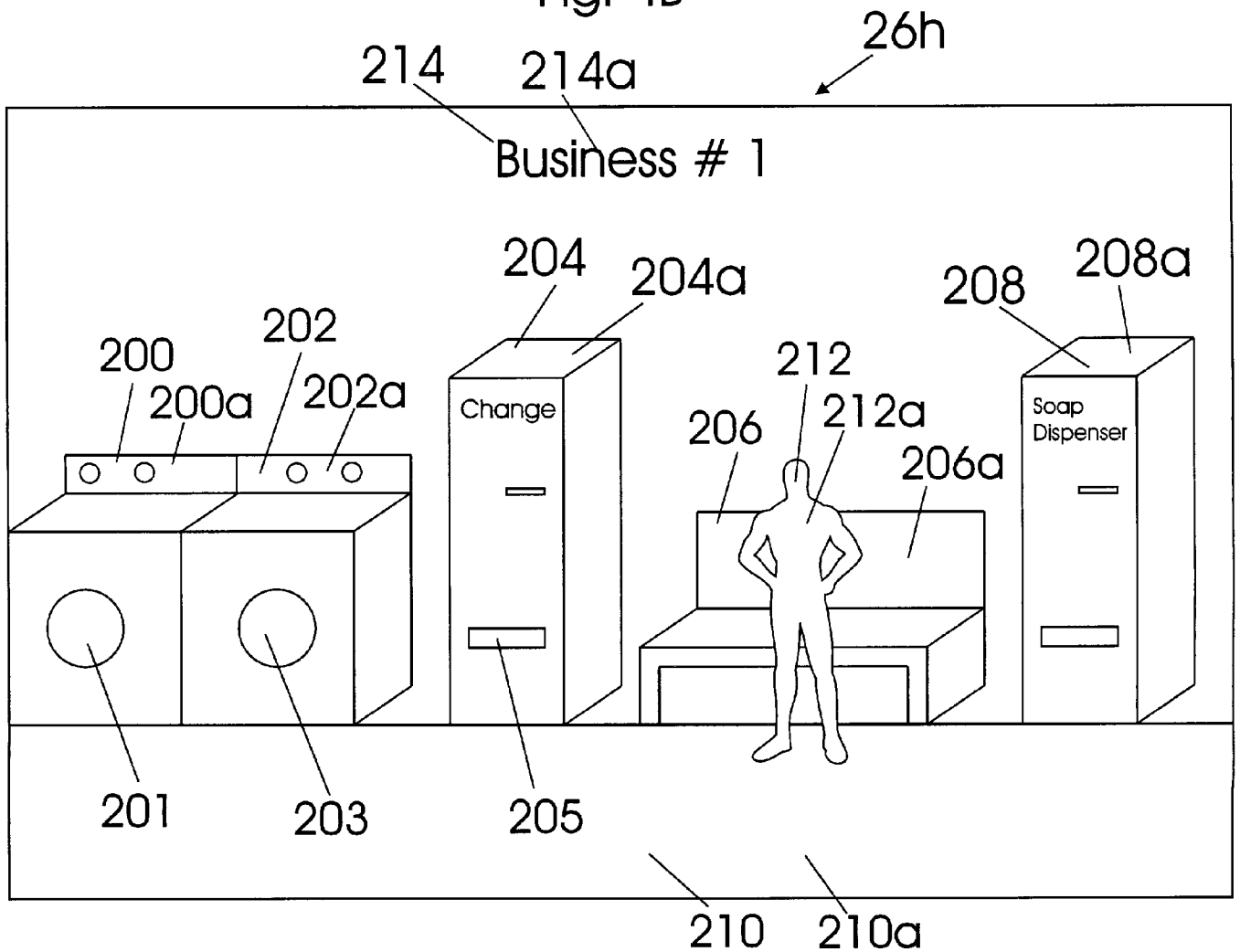
FIG. 4B shows an eighth video image of a plurality of video objects in an eighth state to be displayed on the screen device for use with the apparatus of FIG. 1A.

FIG. 4B shows an eighth video image 26*h* of a plurality of video objects in an eighth state to be displayed on the screen device 26 for use with the apparatus 10 of FIG. 1A. The eighth video image 26*h* shows a drastically different scene from the video image 26*g* of FIG. 4A. In one embodiment, when the rat 126 overlaps or contacts the door 102 of video image 26*g* of FIG. 4A, the screen 29 may black out, i.e. nothing may be displayed for an instant, then an entirely new scene which is shown as video image 26*h* in FIG. 4B may be displayed. In one embodiment, the rat 126 is no longer displayed on the screen 29. Rather, a person has to roll another coin in order to get the rat 126 to come up on the screen 29. The rat 126 may come up on the screen 29 and run from the bottom 29*b* of the screen 29 upwards towards the top 29*c* of the screen 29 in the scene inside business #1 shown by video image 26*h*, with the addition of the rat 126, similar to as previously described for the scene outside the business #1 shown by FIGS. 2A–4A.

The video image 26*h* includes a washing machine target video object 200, a dryer target video object 202, a change machine target video object 204, a bench target video object 206, a soap dispenser target video object 208, a floor target video object 210, a person target video object 212, and a business name target video object 214. The target video objects 200, 202, 204, 206, 208, 210, 212, and 214 are shown in states 200*a*, 202*a*, 204*a*, 206*a*, 208*a*, 210*a*, 212*a*, and 214*a* in FIG. 4B. The target video objects 200 and 202 may include portals or doors 201 and 203 respectively. The change machine target video object 204 may include dispensing area 205. When the coin generated video object, such as a rat 126 enters the screen 29 in video image 26*h* or in a somewhat modified form of video image 26*h*, the rat 126 may contact or overlap washing machine target video object 200 which may cause it to change state. For example, the rat 126 contacting the washing machine 200 may cause clothes to appear to be spinning through the portal 201. Similarly any of the other target video objects may change in appearance or state, such as in color, shape, size, or in any other manner, in response to the rat 126 coming within a certain distance of the appropriate target video object or within a certain distance of another target video object.

The rat 126 may be replaced by any type of video or display object, such as a tank which may move up the screen 29 and fire at an opposing army; an arrow which may move up screen 29 shooting at target video objects; or a torpedo shooting at moving ships.

When the rat 126 or other coin generated video object intersects, hits, or comes within a certain distance of a target video object, the ticket dispensing device 39 inside the housing 28 may dispense a certain number of tickets through the ticket dispensing slot 39*a*. The ticket dispensing device 39*a* would communicate with and/or be electrically connected to computer processor 27 of the screen device 26. The number of tickets dispensed may be dependent on the particular target video object hit. For example, if the rat 126 intersects with the person target video object 212, five tickets may be dispensed or awarded by the ticket dispensing device 39 through the ticket dispensing slot 39*a*. If the rat 126 intersects with the bench target video object 206, four tickets may be dispensed or awarded by the ticket dispensing device 39 through the ticket dispensing slot 39*a*.

The present invention is particularly useful for coin redemption games, i.e. where the ultimate objective of the game is to win tickets which can be accumulated and exchanged for prizes at arcades. Players use their skills both in timing and aiming to cause the coin generated video object, in one example, the rat 126, to intersect with the target video object that has the potential for getting the player the most tickets per coin rolled. In addition to the enticement of tickets, the present invention in one or more embodiments entices players to roll at target video objects so that completely different scenes or video images may be displayed, like the change from the scene in FIG. 4A to the scene in FIG. 4B. The scene of video image in FIG. 4B can be replaced by any type of scene, video image, or animation including for example a humorous cartoon. This provides an award which is not based merely on tickets and provides the owner of the game or machine, such as apparatus 10, with a greater payoff percentage. (i.e. the players will play merely to see further cartoons or video images or scenes, without having to give out more tickets and with more tickets, more merchandise.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a surface having a first end and a second end;

a video screen located near the second end of the surface, wherein the video screen has a bottom and a top;

a sensing device located near the second end of the surface; and a computer processor;

wherein a coin can be rolled in a first direction from the first end of the surface to the second end of the surface;

wherein the sensing device detects the coin near the second end of the surface;

and wherein the sensing device causes the computer processor to display a coin generated video object at a first location near the bottom of the video screen and thereafter at one or more further locations on the video screen which are further from the bottom of the video screen than the first location in response to the detection of the coin near the second end of the surface;

wherein the displaying of the coin generated video object at the first location and at one or more further locations makes it appear that the coin generated video object is moving in a second direction from the bottom of the video screen towards the top of the video screen;

wherein the first direction is at a first angle with respect to an edge of the surface wherein the edge of the surface is substantially perpendicular to the first and second ends of the surface; and wherein the second direction is substantially at the first angel with respect to an edge of the video screen, wherein the edge of the video screen is substantially perpendicular to the bottom and the top of the video screen.

2. The apparatus of claim 1 wherein the video screen displays at least one target video object.

3. The apparatus of claim 2 wherein the surface is in a first plane;

wherein the video screen is in a second plane;

wherein the first plane is at a second angle with respect to the second plane;

wherein the second angle is between ninety and one hundred eighty degrees;

and wherein the video screen and the surface do not face each other and can be seen by an individual at the same time.

4. The apparatus of claim 2 wherein the at least one target video object changes from a first state to a second state on the video screen when the coin generated video object is near the at least one target video object; wherein the first state and the second state differ.

5. The apparatus of claim 4 wherein in the first state the at least one target video object has a first appearance and in the second state the at least one target video object has a second appearance which differs from the first appearance.

6. The apparatus of claim 2 wherein when the coin generated video object is near the at least one target video object, a plurality of video objects change from a first state to a second state, wherein the first state and the second state differ.

7. The apparatus of claim 1 wherein the surface is in a first plane;

wherein the video screen is in a second plane;

wherein the first plane is at a second angle with respect to the second plane;

wherein the second angle is between ninety and one hundred eighty degrees;

and wherein the video screen and the surface do not face each other and can be seen by an individual at the same time.

8. A method comprising the steps of:

detecting a coin after the coin has rolled over a surface; and displaying on a video screen a coin generated video object upon detecting the coin; and wherein after the coin rolls in a first direction from a first end of the surface to a second end of the surface first displaying the coin generated video object at a first location near a bottom of the video screen and thereafter displaying the coin generated video object at one or more locations further from the bottom than the first location on the video screen so that the coin generated video object appears to move in a second direction from the bottom of the video screen towards a top of the video screen;

wherein the first direction is at a first angle with respect to an angle of the surface, wherein the edge of the surface is substantially perpendicular to the first and second ends of the surface; and wherein the second direction is substantially at the first angle with respect to an edge of the video screen wherein the edge of the video screen is substantially perpendicular to the bottom end the top of the video screen.

9. The method of claim 8 wherein the surface is in a first plane;

wherein the video screen is in a second plane;

wherein the first plane is at a second angle with respect to the second plane;

wherein the second angle is between ninety and one hundred eighty degrees; and and wherein the video screen and the surface do not face each other and can be seen by an individual at the same.

10. The method of claim 8 and further comprising displaying at least one target video object on the video screen.

11. The method of claim 10 wherein the target video object changes from a first state to a second state on the video screen when the coin generated video object is within a certain distance of the target video object, wherein the first state and the second state differ.

12. The method of claim 11 wherein in the first state the target video object has a first appearance and in the second state the target video object has a second appearance which differs from the first appearance.

13. The method of claim 10 wherein when the coin generated video object is within a certain distance of the target video object, a plurality of video objects change from a first state to a second state, wherein the first state and the second state differ.

* * * * *